United States Patent [19]

Arieh et al.

[11] Patent Number: 4,519,150

[45] Date of Patent: May 28, 1985

[54] SKI BOOT

[75] Inventors: Simon Arieh; Guy Courvoisier, both of Geneva, Switzerland

[73] Assignee: Battelle Memorial Institute, Carouge, Switzerland

[21] Appl. No.: 460,026

[22] Filed: Jan. 21, 1983

[30] Foreign Application Priority Data

Jan. 22, 1982 [CH] Switzerland ..... 395/82

[51] Int. Cl.[3] ..... A43B 5/04; A43C 11/14

[52] U.S. Cl. ..... 36/121; 36/50; 24/715 K

[58] Field of Search ..... 36/117–121, 36/50; 24/685 K, 695 K, 715 K

[56] References Cited

U.S. PATENT DOCUMENTS

| | | | |
|---|---|---|---|
| 3,600,761 | 8/1971 | Mathey | 24/715 K |
| 4,138,828 | 2/1979 | Kubelka | 36/121 |

FOREIGN PATENT DOCUMENTS

| | | | |
|---|---|---|---|
| 0086908 | 8/1983 | European Pat. Off. | 36/120 |
| 1805251 | 5/1970 | Fed. Rep. of Germany . | |
| 1472863 | 1/1967 | France . | |
| 2491304 | 4/1982 | France . | |
| WO81/01644 | 6/1981 | PCT Int'l Appl. . | |
| 388809 | 6/1965 | Switzerland | 24/715 K |
| 512204 | 10/1971 | Switzerland . | |
| 518071 | 3/1972 | Switzerland . | |
| 549970 | 6/1974 | Switzerland . | |
| 611496 | 6/1979 | Switzerland . | |
| 623209 | 5/1981 | Switzerland . | |

*Primary Examiner*—James Kee Chi

*Attorney, Agent, or Firm*—Karl F. Ross; Herbert Dubno

[57] ABSTRACT

A ski boot has a cuff pivotally connected to its lower shell member and a latch mechanism for holding the cuff in a predetermined angular orientation with respect to the shell member. The easily operated latch mechanism comprises a toggle linkage whose actuating lever is pivotally connected to the cuff within a window formed within a reinforcing rib along the spine of the cuff and connected to an articulation between a pair of links which can be swung to either side of a metastable position by the lever.

14 Claims, 7 Drawing Figures

◎ $E_a$

◎ $E_b$

◎ $E_c$

SKI BOOT

FIELD OF THE INVENTION

Our present invention relates to a ski boot and, more particularly, to a ski boot of the hinged type having a sole member engageable by the ski binding and encompassing for the most part the foot of a skier below the ankle joint and a cuff enclosing a portion of the lower leg above the ankle joint and hinged to the lower member of the boot while being connected therewith by a mechanism holding the cuff in a predetermined orientation relative to the lower member about the common pivot.

BACKGROUND OF THE INVENTION

Articulated ski boots having upper and lower members pivotally connected together at a hinge-type joint substantially in the region of the ankle of the user have been proposed to allow increasing skiing flexibility since they permit adjustment of the angle at which the cuff holds the inferior or distal extremity of the leg relative to the ski to which the lower member is secured.

The boot generally comprises a casing formed from the two enclosures previously described, which can be relatively rigid shells and a lining which can be applied to a sock and/or can be previously fitted into the casing part and composed of a relatively thick, yieldable, form-fitting and flexible material, e.g. a synthetic-resin foam.

The locking means for securing the cuff at a predetermined orientation to the lower casing member or sole piece of the boot is generally provided along the rear thereof in the region (spine) of the boot paralleling the Achilles tendon of the skier and may be adjustable and/or releasable.

Swiss Pat. No. 518,071, for example, shows a ski boot of which the latter locking device is of a particularly simple type since it is constituted basically by a metal tongue rigid with the upper member of the cuff of the boot and presenting a lug adapted to be introduced into a receiving element fixed to the lower member or sole piece of the boot.

The lug or projection can engage any one of a number of seats provided at different levels and adapted to be locked selectively at these levels to secure the upper member of the boot at a particular selected angle with respect to the lower member.

A somewhat more complex configuration has been shown in Swiss Pat. No. 512,204. Here the locking device comprises a piston assembly coupling the upper and lower parts of the boot and in which the friction stroke is limited by an adjustable means.

Still another arrangement for bracing the cuff or upper member with respect to the sole piece or lower member of the boot casing is found in Swiss Pat. No. 519,970, in which the lower tongue projects upwardly into a flat socket of the upper member receiving said tongue and the two are locked together by a bail passing through holes or bores of the tongue.

Swiss Pat. No. 623,209 abuts a mechanism on the upper member against a portion of the ski binding or latches the upper member relative to the lower member by a latching mechanism swingable about the pivot between the upper and lower casing member and braced, in turn, upon a portion of the binding.

In Swiss Pat. No. 611,496, mechanisms are described for adjusting the location of the pivot and include a tension member reaching toward the back of the ski boot.

In French Pat. No. 1,472,863 another tension system reaching below the boot has been shown, this arrangement utilizing an elastic band connecting the cuff with the sole portion of the ski.

French Published Application No. 2,491,304 describes a tongue and socket connection between the pivotal upper member and still another member of the cuff.

German Open Application No. 1,805,251 provides a ratchet arrangement in which a pivotal pawl has a tooth which engages in teeth provided in the lower member and braced against the upper member or connected thereto.

The ski boot of the published PCT application corresponding to the International Publication No. WO 81 01644, in which U.S. Pat. No. 3,561,139 was cited, describes a ski boot in which the cuff assembly is coupled to the lower shell member by an adjustably located pivot utilizing various slot configurations.

From the foregoing summary of the state of the art known to applicant at the time this invention was made, it should be apparent that a wide variety of mechanisms has been proposed for adjusting the orientation of the cuff or upper shell member on the lower shell member or sole piece of the boot.

These mechanisms can be divided basically into a small number of categories. In the first category are those which adjust the position of the pivot. These systems have the disadvantage that they cannot always effectively brace the cuff member with respect to the lower shell member in a fixed position of a pivot, so that the skier must either be uncomfortable or must readjust his boot in an inconvenient way.

A second group utilizes bracing systems for the upper cuff member which depend upon the binding and are particularly prone to problems arising from the accumulation of snow on the binding.

A third group utilizes catches and releases on the back or underside of the boot of a type which requires these releases to be exposed to the elements and to therefore become packed with snow and ice to make their use difficult.

Finally, there are systems which, although apparently simple, do not permit setting of the angle satisfactorily.

OBJECTS OF THE INVENTION

It is, therefore, the principal object of the present invention to provide an improved ski boot which overcomes the disadvantages of these earlier systems.

A more specific object of the invention is to provide a robust, reliable, easily manipulated mechanism for setting the inclination of a cuff to the lower shell member of a ski boot.

It is also the object of the invention to provide a ski boot of the hinged type which has a mechanism for setting the inclination of the cuff relative to the lower shell member and which is not readily contaminated by snow or ice and, if contaminated, can nevertheless be readily manipulated.

SUMMARY OF THE INVENTION

These objects and others which will become apparent hereinafter are attained, in accordance with the present invention, in a ski boot which comprises a lower shell member or sole piece which can be provided with the formations necessary to releasably secure the ski boot on the ski binding, a cuff or upper member pivotally connected to the lower shell member about a horizontal axis located generally in the region of the ankle joint of the user, and locking means interconnecting these two members along the back or spine of the ski boot and adapted to impart a predetermined adjustable inclination to the axis of the cuff relative to the lower shell member in a locked position.

According to the invention, the locking means comprises first and second links articulated to one another about a first pivot axis, one of these links being pivotally connected to the cuff about a second axis parallel to and spaced from the first pivot axis and the other link being pivotally connected to the shell member of the boot about a third axis parallel to the first and second axis and all three axes being parallel substantially to the pivot axis by which the upper or cuff member is pivotally connected to the lower or shell member. The first pivot axis, therefore, lies between the second and third pivot axes.

An actuating lever is part of the toggle linkage formed by the two links and is provided to swing them about the second and third axes respectively, this lever being preferably pivotally connected to one of the members independently of the first, second and third axes, i.e. at a fourth pivot axis, and having a free end such that, when the free end is pressed toward the boot, the linkage locks the two members together and when the free end is swung away from the boot the linkage assumes another nonlocking position spaced from the first position and in which the two members are not locked together. Of course, the lever can be one of the links.

According to the invention, stop means is provided on one of these members in the angular trajectory of at least one abutment member kinematically rigid with one of the links in such manner as to preclude any angular displacement of the linkages, when the links are in a locking position.

According to the invention, moreover, elastic means is provided to bias the abutment into engagement with the stop means and thus in a manner tending to maintain the two members locked together.

According to a feature of the invention, the actuating lever is pivotally connected to the linkage at the first pivot and is positioned so as to actuate the linkage in the manner of a toggle, i.e. by swinging this first pivot through a metastable position in which it lies in a plane defined by the second and third pivots to a locking position in which the first pivot is disposed between the wall and the spine of the boot. In the unlocking position the first pivot lies to the side of this plane which is opposite the spine of the boot.

According to yet another feature of this invention, at least one of these links is a link of adjustable length, i.e. can comprise a screw threaded into a nut. One of these threadedly interconnected elements can thus be articulated to the other link at the first pivot, while the other threaded element is provided with the respective pivot (second or third pivot) to the corresponding member (cuff or sole piece).

Both the second and third pivots, or at least one of them, can be formed in a hook or notch portion formed on the respective member, enabling the pivot to be withdrawn from the hook for complete release of the respective member by the locking device. Furthermore, we have found it to be advantageous to provide the fourth pivot, i.e. the pivot between the actuating lever and its member, preferably the cuff, so that it is coplanar with the second and third pivots.

BRIEF DESCRIPTION OF THE DRAWING

The above and other objects, features and advantages of the present invention wiull become more readily apparent from the following description, reference being made to the accompanying drawing in which.

SPECIFIC DESCRIPTION

Figure 1:
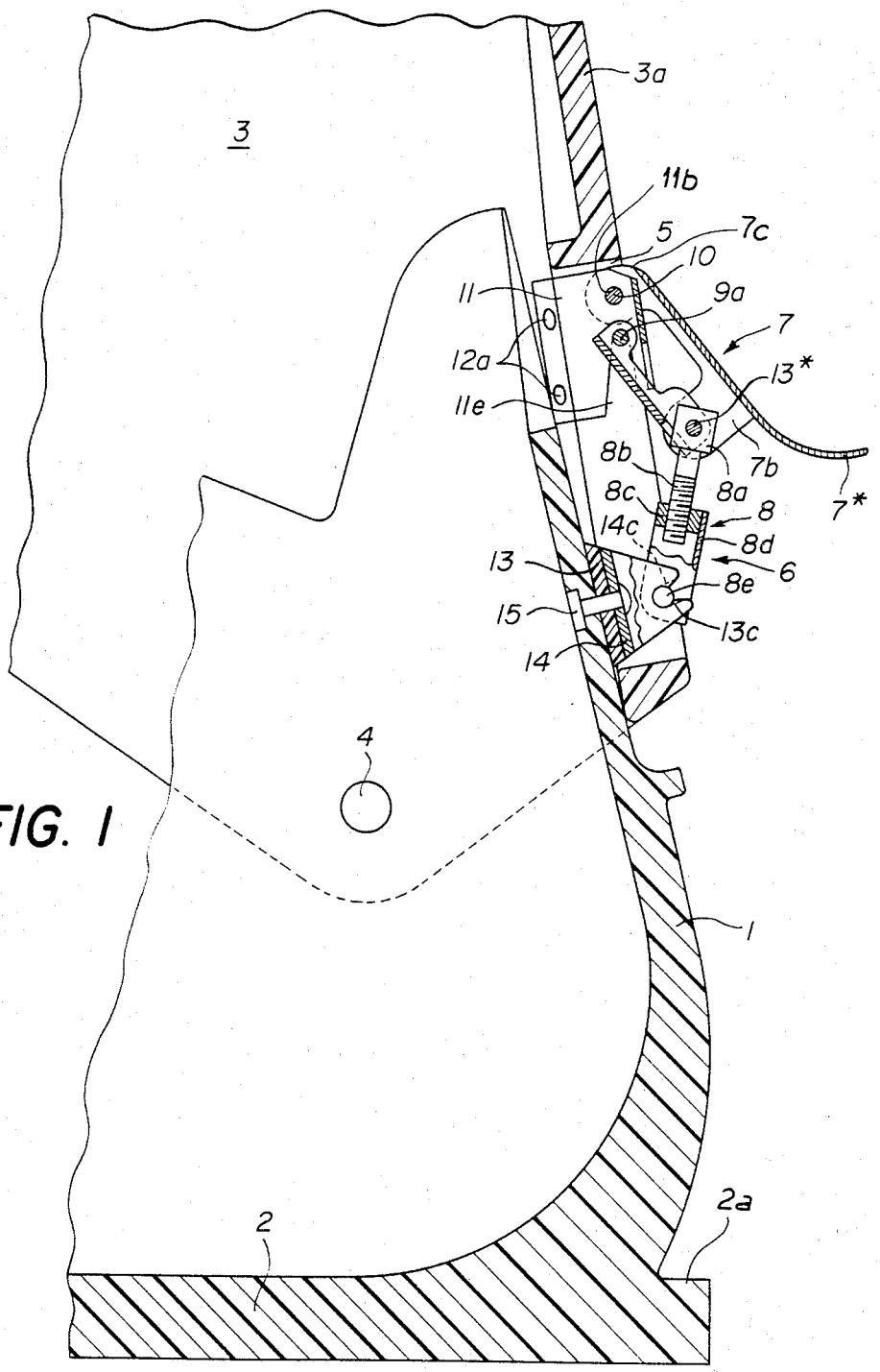
FIG. 1 is a vertical partial section through the back of a ski boot provided with a locking mechanism according to the invention and with the mechanism shown just prior to full release or just prior to full locking with the toggle in its unlocking position.
Figure 2:
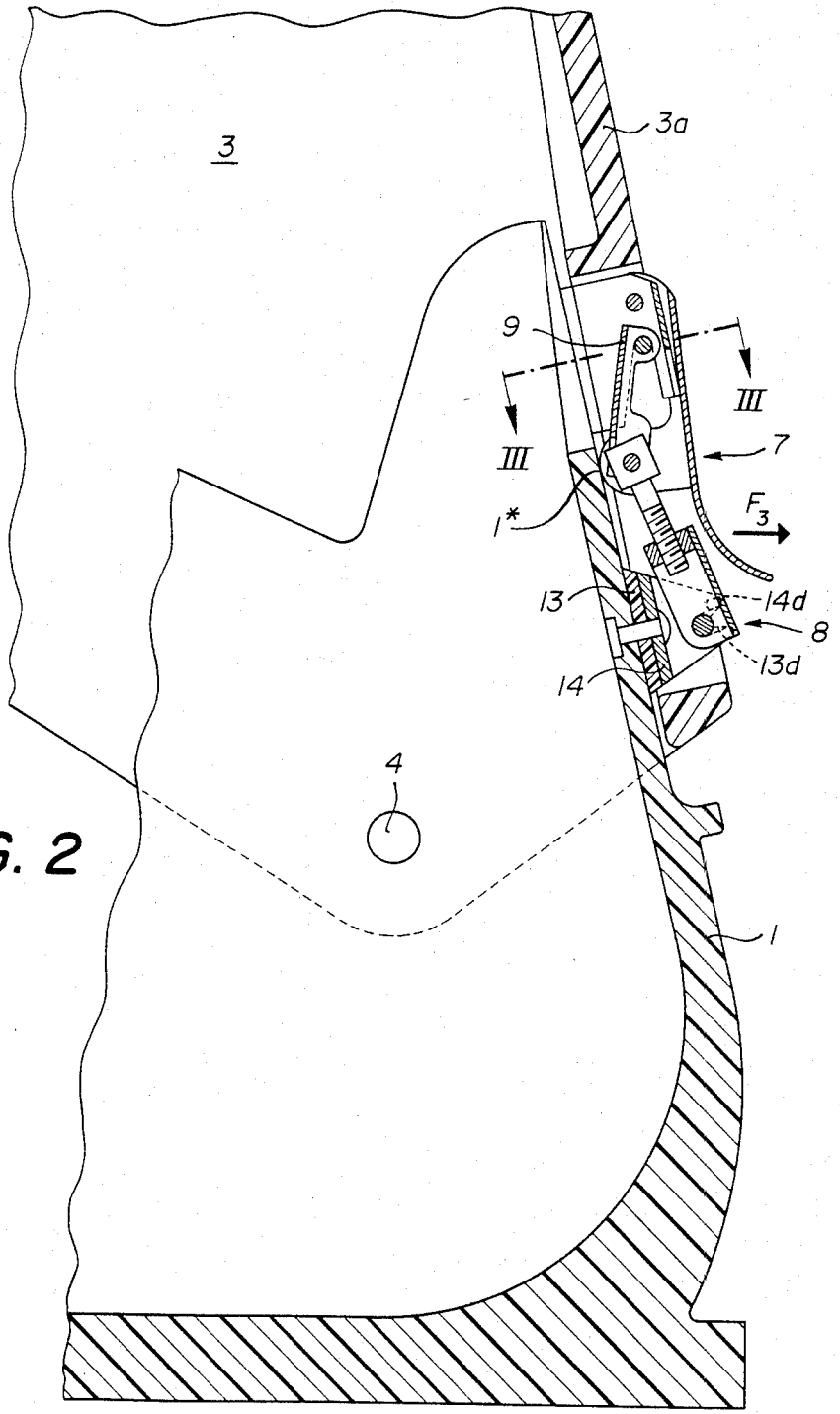
FIG. 2 is a view similar to FIG. 1 showing the locking position of the toggle.
Figure 4:
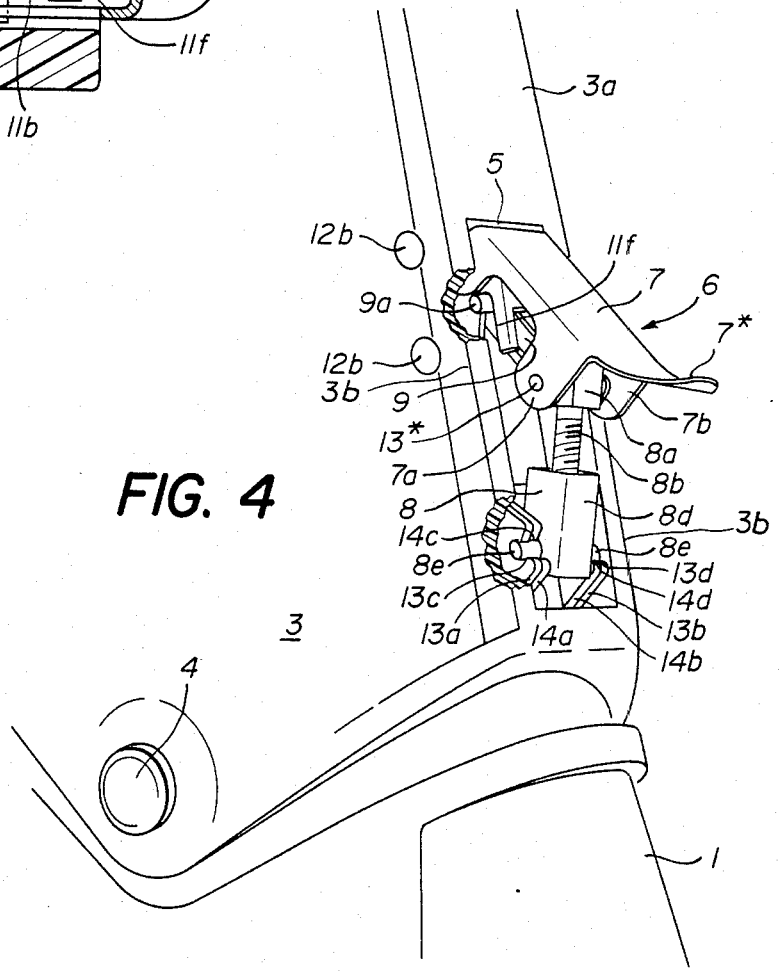
FIG. 4 is a partial perspective view of the locking mechanism with parts broken away.

The ski boot according to the invention, only a portion of the rear of which is visible in FIGS. 1, 2 and 4, comprises, as is conventional, a lower shell member 1 which is also referred to as the sole piece because it is provided with a sole 2. The shell member 1 is also provided with formations, e.g. a ledge 2*a* at the heel of the boot, which can be engaged by the heel clamp or cable of the ski binding. Corresponding formations are also provided at the toe of the casing for engagement with the toe clamp of the binding and the upper of the casing can have ledges or the like enabling the foot of the skier to be secured in place after he has drawn onto his foot the customary sock. The boot is also equipped with a cuff or upper member 3 which likewise can be closed around the lower limb of the skier.

This tubular cuff is pivotally connected to the lower member 1 by pivots 4 on opposite sides of the boot and defining a horizontal pivot axis substantially in the region of the ankle pivot of the skier.

The back of the upper member 3 is reinforced by a ridge 3*a* which extends along the spine of the boot and, at its lower part, is cut away to provide a window 5 defined between a pair of flanges 3*b*. The locking device represented generally at 6 is disposed within the window 5 and serves to lock the upper member 3 in a selected angular position with respect to the lower member 1.

This locking device comprises three links 7, 8 and 9 and forms a toggle linkage.

The first of these links 7 is an actuating lever which, except for its outwardly turned end 7* (see FIG. 4), practically completely closes the opening or window 5 when swung inwardly into the position shown in FIG. 2.

Figure 3:
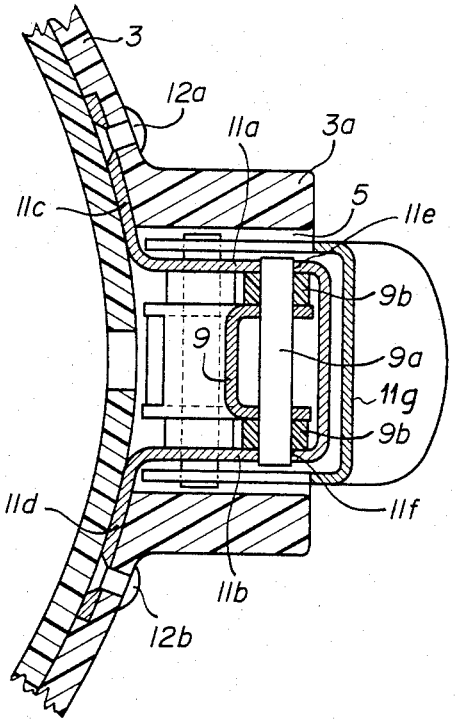
FIG. 3 is a section along the line III—III of FIG. 2.

This actuating lever 7 is pivotally connected at its upper end, e.g. by the pivot pin 10 to the upper member 3 at the rib 3*a*. As can be seen especially from FIG. 3, the upper member is formed with a stirrup 11 which has a pair of wings 11*c* and 11*d* projecting outwardly from parallel flanges 11*a* and 11*b* of the stirrup 11. These flanges are connected by a web 11*g* and have holes 11*h* (FIG. 1) only one of which has been shown to receive the pin 10. The wings 11*c* and 11*d* are fixed by rivets 12*a* and 12*b* (FIG. 3) to the rib 3*a* which, in turn, is molded as part of the cuff 3 previously mentioned.

At its upper end, the lever 7 is also provided with a pair of flanges 7*c* only one of which can be seen in FIG. 1 which also engages the pin 10. In the kinematic diagrams of FIGS. 5*a* through 5*c*, the pivot axis defined by the pin 10 for the actuation lever 7 is located at A, A', or A".

Thus, the stirrup 11 projects into the window 5 and forms the support on the cuff member 2 for the pivots which are located on this cuff.

At a central portion along its length, the lever 7 is provided with a pair of eyes 7*a* and 7*b* forming a support for a pivot pin 13* of a head 8*a* formed at the end of a threaded screw 8*b*. This threaded screw is adjustably received in a nut 8*c* fixed at the upper end of a channel 8*d* whose U-section provides a pair of flanges which carry a pivot pin 8*e* (FIGS. 1 and 4). The elements 8*a* to 8*e* form the link 8 which is connected by the third pivot to the casing member 1 in a manner which will be described, the first pivot of the toggle being formed by the pin 13*.

As also can be seen from the FIGS. 1 and 4, this link 8 can be inserted into pair of eyes 13*a*, 13*b* and a pair of links 14*a* and 14*b* lying adjacent one another, these eyes being provided on a pair of U-profiles 13 and 14 respectively. The eyes which open outwardly and thus constitute hooks or notches as previously described from which the pin 8*e* can be resiliently withdrawn or into which the pin 8*e* can be resiliently inserted, thus forming means for securing the lower or third pivot to the shell member 1.

The U-profiles 13 and 14 are fixed to the lower member 1 of the boot by a rivet 15.

The notches 14*c* and 14*d* have openings corresponding to the diameter of the pivot plane 8*a* while the notches 13*c* and 13*d* have openings slightly less than this diameter. The profile 14 is composed of a relatively rigid material such as a metal, aluminum or a stainless steel such as inox, for example, while the profile 13 is composed of a more resilient and flexible material such as a synthetic resin. Thus member 13 provides a spring force which retains the pin 8*e* in the notches while member 14 provides the strength necessary to resist any force tending to extract the pin 8*e* in a direction parallel to the plane of the linkage, the notches being opened outwardly, transversely to this plane.

By threading the screw 8*b* further into or out of the nut 8*c*, the effective length of the link 8 can be varied and hence the angle of the cuff can be adjusted.

The link 9 is articulated to the link 8 by the pin 13* and, at its end opposite the pivot 13*, is pivotally and slidably connected to the stirrup 11.

More particularly, the link 9 is provided at this end with a further pivot pin 9*a* (second pivot) which can slide (FIGS. 1 and 4) within vertical notches 11*e*, 11*f* formed in the flanges 11*a* and 11*b* of the stirrup 11.

Washers 9*b* of an appropriate synthetic-resin material, for example, Delrin or Nylon, center the link with respect to the lateral faces of the flanges 11*a* and 11*b* of the stirrup 11.

The links and thus the moments of inertia of the three links 7, 8 and 9 are selected such that the resistance of yielding of the links 7 and 8 is substantially greater than that offered by the link 9 for the same type of action.

The resiliently deformed link 9 thus functions as a somewhat flexible member which can act as a spring or elastic means.

The upper ends of the notches 11*e* and 11*f*, in which the pivot pin 9*a* can be seated to define the second pivot axis D (see FIGS. 5*a*, 5*b*, 5*c*), are located at a distance from the pivot rod 13* slightly less than the distance between the upper stop of the pivot axis 9*a* of the link 9 and the same pivot 13* when the toggle assembly is in a condition of metastable equilibrium in which all four axes, defined by the pivots 10, 9*a*, 13* and 8*e* are coplanar.

Figure 5A:
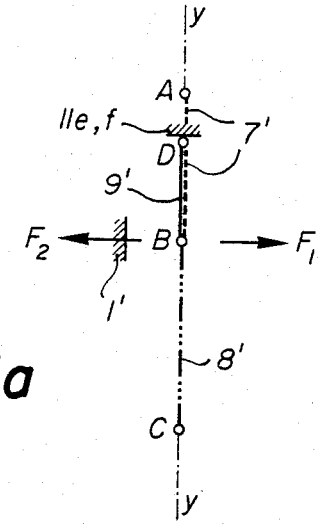
FIGS. 5*a* through 5*c* illustrate the kinematic relationships of the metastable and stable positions of the ledge.

In this position the link is somewhat bent or deformed in a force-storage position to enable the toggle to spring into either of its stable positions with the pivot 13* lying at its side of this common plane which has been designated as the y—y plane in FIG. 5*a*, for example.

Consequently, this link 9 forms a spring tending to bias the toggle 7, 8 into its locking stable position (FIG. 2) or its unlocking stable position (FIG. 4) from the metastable position shown in FIG. 5*a*. In the locking position (FIG. 2), the cuff 3 is held angularly in position about the pivot 4 which has been preselected by the adjusted length of the link 8.

Figure 5B:
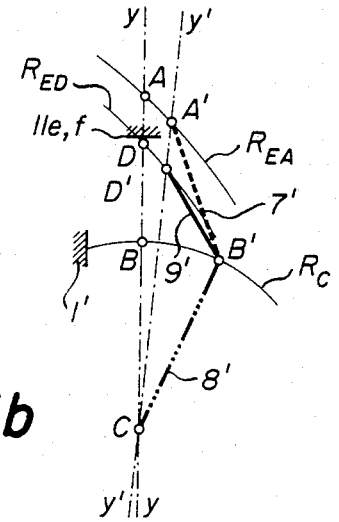
Figure 5C:
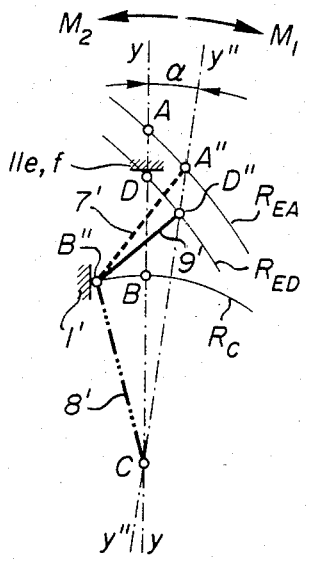

To appreciate the various positions of the linkage of the invention, reference may be had to FIGS. 5*a*, 5*b*, 5*c* in which the links 7, 8 and 9 are represented simultaneously by a dashed line 7', a dot-dash line 8' and a solid line 9', respectively.

The first axes in these FIGS. are represented by the points B, B', B" while the second and third axes are represented by the points D, D', D" and C, respectively.

The lever axis is represented at A, A', A". In each case, the articulation axis 4 between the upper member 3 and the lower member 1 of the ski boot is represented by the points $E_a$, $E_b$ and $E_c$ in FIGS. 5*a*, 5*b* and 5*c*, respectively.

In these FIGS., one can also see arcs $R_{EA}$ and $R_{ED}$, respectively, designating the circular trajectories for the points A and D upon tilting of the upper member 3 relative to the lower member 1 about the axis 4, both the latter axis and the point C being assumed to be fixed relative to the ski.

The reference character $R_C$ indicates the circular trajectory of the point B upon tilting of the lower link 8 about its articulation point C (see FIGS. 5*b* and 5*c*).

The hatched portion 11*e*,*f* represents the upper extremity of the notches 11*e* and 11*f* formed in the stirrup 11 and against which the pivot 9*a* of the upper link 9 comes to rest when the toggle is in its metastable position and the pivot axes A through D are coplanar (FIG. 5*a*).

The hatched portion indicated by the reference numeral 1' corresponds to the part 1* forming the spine of the lower member 1 against which lugs 7*a* and 7*b* of the lever 7 come to rest in the locking position shown in FIG. 2

FIG. 5*b* corresponds essentially to the position shown in FIG. 1. A deadcenter or metastable position at the plane y—y in this figure can be traversed by the pivot B' when the lever 7 is shown in the clockwise sense abouts its pivot A to thereby rotate the link 8 in the counterclockwise sense and the link 9 in the clockwise sense. Since the link 8 is not axially compressed, the pivot D is first raised until it comes to rest at the abutment 11*e*, *f*, thereby compressing the link 9. As the lever 7 continues its movement, it carries the pivot B' past the deadcenter or metastable position where the resistance by relaxation of the force storing spring 1 is held against further movement by the abutment 1'. This, of course, locks the assembly.

In the position shown in FIG. 5*b*, however the cuff 3 is not locked, i.e. it can pivot more or less freely about the axis 4.

In the unlocked position of FIG. 5*b*, until the lower pin 8*a* is released, the upper cuff can swing about the axis 4 as represented, for example, by the angle separating the plane y—y from the plane y'—y'. To increase the angle it is merely necessary to swing the lever 7 in the counterclockwise sense by manual action upon the upturned tongue 7. In this case, the link 8 (represented by the line 8) pivots about the axis C of the pin 8*e* as the pivot 10 of the lever moves along the path $R_{EA}$ a circular arc centered upon the axis $E_b$ corresponding to the pivoting axis of the cuff. Simultaneously, the link 9 will be entrained by the pivot axis 13* along the trajectory $R_C$ centered on the pivot axis C while the second pivot axis D' moves along the path $R_{ED}$ centered at $E_b$. The latter movement corresponds to an axial displacement within the grooves 11*e* and 11*f*.

In practice, the extreme position into which the cuff can be tilted when the latch is open is a function of the respective length of the three links 7, 8 and 9 and thus the metastable kinetic relationship of these links in FIGS. 5*a* through 5*c*. Of course, since the link A is of a variable length, this position can be varied by the user to obtain the degree of mobility for the cuff which he desires.

In the locked position of FIG. 5*c* the angular displacement is limited to the angle $\alpha$.

More specifically to lock the upper member or cuff 3 in the position for securing, the lever 7 is approximated to the spine of the boot, i.e. shown in the clockwise sense to carry the pivot 13* the metastable position of FIG. 5*a* into the other stable position of FIG. 5*c* in which the spring force generated by the link 9 holds the pivot B in its position B'' against the abutment 1'. Here again, at least initially the pivot 9*a* is seated at the top of the grooves 11*e* and 11*f*, thereby producing the elastic action of the link 9. As the pivot 13* swings past the plane y—y, the toggle jumps into the position shown in FIG. 5*c*.

The maximum displacement in the direction of arrow $F_2$ is limited by the engagement of the lugs 7*a* and 7*b* of lever 7 with the stop 1* (see FIG. 2). This position corresponds to the contact of the point 13 at B'' with the hatched zone 1' in FIG. 5*c*.

During the limited tilting movement of the cuff which this locked position can permit, the points A and D can swing along the trajectories $R_{EA}$ and $R_{ED}$ centered upon the axis $E_c$.

Angle $\alpha$ representing the maximum angular excursion of the cuff in the locked position can be selected to suit the needs of the skier by adjustment of the effective link of the link 8 in the manner described.

It is noted that whether the force on the cuff is applied rearwardly (arrow $M_1$) or forwardly (arrow $M_2$) the effect on the linkage is to urge the point B further into contact with the surface 1' and thus the faces of the cuff tend to keep the latch closed.

In order to release the linkage it is merely necessary to swing the tongue 7* outwardly (arrow $F_3$ in FIG. 2) whereupon the spring force will, as the pivot 13* swings past the plane y—y, cause the latch to jump into its open or unlocking position.

The device is thus easily operated, is reliable, does not self-release and is not susceptible to opening because of the accumulation of snow or ice and does not become more difficult to open because of such accumulations. The pivots composed of Nylon or Delrin remain easily operable under all conditions and the unit can be actuated readily even by a user wearing gloves or mittens.

We claim:

1. In a ski boot having a lower member in the form of a casing formed with a sole piece and adapted to receive the foot of a skier, an upper member forming a cuff around the leg of the skier, means defining a pivot between said members substantially in the region of the ankle joint of the leg and foot, and latch means interconnecting said members, the improvement wherein said latch means comprises:

a toggle linkage having at least a pair of elements pivotally connected to one another at a first pivot;

means pivotally connecting one of said elements to said upper member at a second fixed on said upper member;

means pivotally connecting another of said elements to said lower member at a third pivot fixedly located on said lower member, said linkage having an actuating lever engaging said first pivot to shift the same toward and away from the boot, said first, second and third pivots having mutually parallel pivot axes with said first pivot disposed between said second and third pivots; and means on the boot forming an abutment, said toggle linkage being engageable with said abutment in a locking position of said linkage when said first pivot is displaced toward the boot, said toggle linkage having an unlocking position when said first pivot is displaced away from said boot, the angular displacement of said upper member relative to said lower member being limited in said locking position, said toggle linkage comprising a first link forming said element pivotally connected to said upper member at said second pivot, a second link pivotally connected to said lower member at said third pivot, said links being pivotally connected together at said first pivot, and an elastically deformable third link pivotally connected said first pivot and to said boot at a fourth pivot having an axis parallel to the axis of said first, second and third pivots and located in a seat formed in a member kinematically fixed to said upper member, said second, third and fourth pivots lying in a plane defining a metastable position of said linkage, said locking and unlocking positions lying to opposite sides of said plane, said elastically deformable third link constituting elastic means for ensuring bistable operation of said linkage.

2. The improvement defined in claim 1 wherein said seat is formed with a pair of slots and said fourth pivot includes a pivot pin shiftable along said slots whereby said pin can bottom in said slots to allow elastic deformation of said third link.

3. The improvement defined in claim 1 wherein said lever forms part of said first link.

4. The improvement defined in claim 3 wherein said lever has a tongue extending beyond its connection to said first pivot.

5. The improvement defined in claim 1 wherein said means forming said abutment includes a portion of an exterior surface of said lower member.

6. The improvement defined in claim 1 wherein said lever is formed with a portion engageable with said means forming said abutment in said locked position.

7. The improvement defined in claim 1 wherein one of said links is of an adjustable length.

8. The improvement defined in claim 7 wherein the link of adjustable length has a threaded screw connected to said first pivot and a nut threadedly engaging said screw and pivotally connected to the respective member.

9. The improvement defined in claim 1 wherein at least one of the means pivotally connecting a link to a respective member includes recesses resiliently engaging a respective pivot pin.

10. The improvement defined in claim 9 wherein said recesses are provided on said lower member.

11. The improvement defined in claim 10, further comprising elastic retaining means for resiliently holding said pivot pin in said recesses.

12. The improvement defined in claim 11 wherein said recesses are formed from a rigid member and have a diameter equal to the diameter of said pin and open outwardly with an opening having a width equal to the diameter of said pin and said elastic retaining means includes an elastic member formed with recesses opened outwardly but of a width slightly less than the diameter of said pin.

13. The improvement defined in claim 1 wherein said upper member is formed with a rib along a spine of the upper member, said rib being provided with a window, said toggle linkage being received with said window.

14. The improvement defined in claim 13, further comprising a stirrup connected to said upper member and below said rib and extending into said window to form said second and fourth pivot axis.

* * * * *